United States Patent [19]

Okinaka et al.

[11] 4,340,451

[45] Jul. 20, 1982

[54] METHOD OF REPLENISHING GOLD/IN PLATING BATHS

[75] Inventors: Yutaka Okinaka, Madison; Catherine Wolowodiuk, Chatham Township, Morris County, both of N.J.

[73] Assignee: Bell Telephone Laboratories, Incorporated, Murray Hill, N.J.

[21] Appl. No.: 104,181

[22] Filed: Dec. 17, 1979

[51] Int. Cl.[3] ..... C25D 3/48

[52] U.S. Cl. ..... 204/46 G; 204/234; 204/DIG. 13

[58] Field of Search ..... 427/345, 304; 106/126; 204/30, 14 R, 46 G, DIG. 13, 234

[56] References Cited

U.S. PATENT DOCUMENTS

| | | | |
|---|---|---|---|
| 2,660,554 | 11/1953 | Ostrow | 204/46 G |
| 2,801,960 | 8/1957 | Seegmiller | 204/46 G |
| 2,967,135 | 1/1961 | Ostrow et al. | 204/46 G |
| 3,303,112 | 2/1967 | Camp | 204/46 G |
| 3,396,042 | 8/1968 | Dura | 427/304 |
| 3,661,732 | 5/1972 | Withrow | 204/DIG. 13 |
| 3,770,596 | 11/1973 | Bick et al. | 204/46 G |
| 3,873,428 | 3/1975 | Winters | 204/46 G |
| 3,879,270 | 4/1975 | Kowalski | 204/46 G |
| 3,917,885 | 11/1975 | Baker | 427/304 |

OTHER PUBLICATIONS

G. Brauer, *Handbook of Preparative Inorganic Chemistry*, 2nd Ed., Academic Press, N.Y. 1965, pp. 1064–1066.

*Primary Examiner*—Norman Morganstern
*Assistant Examiner*—Janyce A. Bell
*Attorney, Agent, or Firm*—Richard D. Laumann

[57] ABSTRACT

The gold content of a gold plating bath is replenished by circulating the plating solution through an AuCN containing vessel. The plating solution contains sufficient free cyanide to render the gold soluble by producing the soluble $Au(CN)_2^-$ ion.

7 Claims, No Drawings

METHOD OF REPLENISHING GOLD/IN PLATING BATHS

TECHNICAL FIELD

This invention is concerned generally with gold plating baths and particularly with a method of replenishing gold in such plating baths.

BACKGROUND OF THE INVENTION

For many years, gold has been a commercially important material, not only because of its esthetic properties, but also because of its electrical, physical and chemical properties. For example, it is electrically conductive and highly resistant to corrosion. These properties have led to increasing gold use in modern high technology applications such as micro-electronic circuitry and electrical contacts. Due to its relative scarcity and resulting high price, gold is generally used as a thin layer on another material. The layer can be applied by a plating process.

The large increase in the price of gold in recent years has stimulated intensive efforts to increase the efficiency of gold plating processes. These efforts have had many aspects. For example, effort has been directed toward reducing the thickness of the gold platings while retaining the desirable characteristics of the thicker platings. Further effort has been directed toward development of gold plating systems that plate selectively and thus do not waste gold by plating in undesired areas. Effort has also been directed toward reducing the volume of the plating solution and, therefore, the amount of gold within the plating system. The latter effort has been intimately connected with the development of high speed gold plating systems. Although there is no precise dividing line between high speed and low speed gold plating, slow speed is typically considered to be between 10 and 20 mA/cm$^2$, and high speed is typically considered to be between 50 and 400 mA/cm$^2$.

High-speed gold plating presents several difficulties and problems that were not present in the prior art low-speed plating methods. Effort has therefore been directed toward development of new apparatus and methods that overcome these difficulties and problems.

One problem that is present in all gold plating baths, but is especially acute with high speed baths, arises because the composition of the plating bath changes continually with use. The change in bath composition makes it difficult to produce a series of platings having uniform properties because of the changes in plating chemistry.

Although many factors contribute to the compositional change in plating baths, the change in the solution composition in high-speed gold plating baths results primarily from three factors. First, there is solution drag-out and the subsequent addition of water. Drag-out is the term used by those working in the art to represent the gold removed from the plating bath by the plated pieces as they are removed from the bath. Second, the concentration of potassium ions varies because potassium cyanoaurate, $KAu(CN)_2$, is conventionally added to replenish the gold. Potassium cyanoaurate is sometimes referred to as potassium gold cyanide. Third, an acid is generally added to control the pH. The last step is required because use of potassium cyanoaurate as the replenishing salt leads to an increase in pH. Potassium cyanide reacts with water to form HCN, a weak acid, and potassium hydroxide. Some of the HCN, boiling point 26 degrees C, escapes, and it is therefore necessary to adjust the pH by adding an acid. Typical acids include citric and phosphoric. However, the potassium ions do not leave the plating bath, and the potassium ion concentration will increase.

The increase in potassium ion concentration is an especially undesirable change in plating bath composition because the concentration may eventually reach a point where the concentration of potassium salts saturates, and they begin to crystallize out of the solution. Undesirable effects result. The crystallization interferes with the normal solution flow, and also alters the solution composition and the properties of the plated material. For example, at 30 degrees C, a typical gold concentration of 30 gms/liter may be maintained up to a $K^+$ concentration of only 3 M.

Methods exist for controlling the potassium ion concentration and maintaining it below saturation. For example, the potassium ion concentration may be controlled and kept below saturation by increasing the drag-out ratio. For any given drag-out ratio, the potassium ion concentration will eventually reach an equilibrium concentration after some number of bath turnovers. A turnover is defined as completed when the gold initially present is plated, this amount is replenished, and the solution volume adjusted. The equilibrium concentration depends upon the drag-out ratio used, and higher drag-out ratios lead to lower potassium ion concentration. Thus, crystallization of the potassium salt may be prevented, but only at the price of unattractively high drag-out ratios. For example, drag-out ratios as high as 12 percent might have to be used. This is undesirable because it necessitates expensive systems for recovering gold from the rinse water.

SUMMARY OF THE INVENTION

We have found that the gold in gold plating baths may be replenished by using gold cyanide, AuCN, as the replenishing salt. The plating solution is circulated through a vessel containing AuCN, typically as pellets. The plating solution contains sufficient free cyanide ions to dissolve the desired amount of AuCN and replenish the gold in the plating solution. The replenishment efficiency may be greater than 100 percent if desired. The described method has the advantage that potassium ions are not introduced into the plating solution, and electrolyte balance in the bath is automatically maintained. Thus, essentially no pH adjustment is required.

DETAILED DESCRIPTION

This invention is a method of replenishing gold in gold plating baths. Basic to the invention is the use of gold cyanide, AuCN, as the replenishing salt. Although AuCN is not soluble in water, it becomes soluble in alkali cyanide solutions. The gold goes into solution via the reaction $AuCN + CN^- \rightarrow Au(CN)_2^-$.

The plating bath may be any conventional gold plating bath, although it has been found that the replenishment method of the invention is especially useful with high speed, i.e., between 50 and 400 mA/cm$^2$, plating baths such as those used for continuous gold plating. The acid used to obtain the desired pH is not critical. For example, citric or phosphoric acid may be used. The plating solution has a free cyanide concentration sufficient to render the desired amount of AuCN soluble. The necessary initial cyanide concentration may be established by using $KAu(CN)_2$, $NaAu(CN)_2$, $LiAu(CN)_2$ or $NH_4Au(CN)_2$ as the salt when the bath is started. The free cyanide that renders AuCN soluble is produced when plating begins. For reasonable plating speeds and efficiencies, the free cyanide concentration should be at least 0.01 gm/liter.

The plating solution is withdrawn from the bath and circulated through at least one vessel containing AuCN. The methods and apparatus used to withdraw and circulate the solution are well known to those working in the art and need not be described in detail. It is sufficient to say that the pump, valves, pipes, etc. used to direct and control the flow between the plating bath and the AuCN containing vessel are either commercially available or may be constructed using well-known techniques.

It is frequently desirable to use two or more vessels which may be connected either in series or in parallel. Use of a plurality of vessels facilitates maintenance, as one vessel may be removed, e.g., to replenish the AuCN, while the bath continues to operate and increases the gold replenishment speed. The solution may be circulated continuously or intermittently through the vessels.

AuCN is a yellow-colored powder which is insoluble in water, but is soluble in solutions of alkali cyanides, KOH, ammonia, $Na_2S_2O_3$ and $(NH_4)_2S$. AuCN is commercially available or, if desired, it may be prepared by well-known techniques such as those described in *Handbook of Preparative Inorganic Chemistry,* Vol. 2, Second Edition, pp. 1064-1065, Academic Press, New York, 1965. The AuCN may be present in any size or shape that permits solution flow through the vessel. Although the AuCN may be used in powder form, it has been found that use in the form of pellets facilitates solution flow, as the possibility of caking is reduced. The pellets may be prepared by pressing AuCN powder at a pressure of 20,000 pounds per square inch. Any convenient pressure may be used. Pellets one-half inch in diameter and one-eighth inch thick may be conveniently used in columns approximately 0.5 to 2.0 inches in diameter and from 6 to 24 inches in length. Such columns give good results in baths having a volume of approximately 20 gallons and a flow rate of approximately 15 liters/min.

The chemical reactions in the gold plating bath for the method of this invention are:

CATHODE: $KAu(CN)_2+H^++e^- \rightarrow Au+KCN+HCN$

ANODE: $\frac{1}{2}H_2O \rightarrow H^++\frac{1}{4}O_2+e^-$

OVERALL: $KAu(CN)_2+\frac{1}{2}H_2O \rightarrow KCN+HCN+\frac{1}{4}O_2+Au$

The overall plating reaction results in the formation of one mole each of KCN and HCN, together with metallic gold and gaseous oxygen, from one mole of $KAu(CN)_2$ and water. The KCN further hydrolyzes to give KOH and HCN via the reaction:

$$KCN+H_2O \rightarrow KOH+HCN$$

Since HCN is a gas at typical bath operating temperatures, all of it will eventually escape into the exhaust assuming normal conditions. However, the rate of escape and, thus, the precise free cyanide, i.e., $CN^-$, concentration will depend upon such considerations as tank size, plating speed and ventilation. The $CN^-$ concentration also decreases as the solution pH decreases. However, HCN is extremely soluble in water, and the HCN concentration in the bath can become very high. For example, it can reach 2 gm/liter. The KCN, as well as the dissolved HCN, is utilized to replenish the plating solution. This replenishment method does not introduce additional potassium ions into the bath.

The replenishment reaction for the dissolved HCN is via the reaction:

$$AuCN+HCN \rightarrow H^++Au(CN)_2^-$$

Some replenishment also occurs for KCN through the reaction:

$$AuCN+KCN \rightarrow K^++Au(CN)_2^-$$

It is to be understood that KCN is directly effective as a replenisher only to the extent that it is so used prior to the hydrolysis reaction.

If one half of the total free cyanide (KCN and HCN) produced in the plating reaction reacts with AuCN, the gold replenishment efficiency is 100 percent. Thus, escape of all the HCN produced, and reaction of all KCN produced with AuCN, leads to a replenishment efficiency of 100 percent.

Under these conditions, the pH of the plating solution remains essentially constant and, therefore, there is no need to add an acid to control the pH.

The pH of the plating solution should be at least 3, as AuCN is not readily soluble at lower pH values. Any pH greater than 3 may be used.

The replenishing system is desirably operated with replenishing efficiency of 100 percent or more to maintain the gold concentration at the desired level. The replenishing efficiency is defined as the ratio of the gold replenished to the weight of the gold plated. The weight of the gold replenished is the product of the change in gold concentration before and after plating and the bath volume. The replenishment efficiency depends upon such factors as the fluid flow rate, the plating bath volume and the amount of AuCN through which the solution flows. The fluid flow rate may be varied, if desired, to obtain the desired replenishing efficiency by circulating the plating solution intermittently through the AuCN containing vessel. Plating solution factors, such as temperature and pH, also have an effect on the replenishing efficiency.

Although analytical expressions are difficult to obtain, empirical relationships, at constant pH, temperature and plating rate, between the fluid flow rate, the plating bath volume, the column length, the column diameter and the replenishing efficiency were developed for a cylindrical column. For a plating solution volume of 1.4 liters, a column diameter of 9/16 inch, a pH between 4 and 7, the replenishing efficiency, R, is approximately proportional to $(V_f/V_b)(C_l/C_d)^{0.7}$, where $V_f$ is the volume flow rate, $V_b$ is the bath volume, $C_l$ is the column length, and $C_d$ is the column diameter. This approximate relationship holds for baths at pH 4 (citrate) and 65 degrees C., as well as baths at pH 7 (phosphate) and 40 degrees C. Similar empirical relationships can be routinely developed for other geometries, temperatures, etc.

The relationship is also easily generalized for variations in pH, temperature, plating speed, etc. For example, if all variables are held constant and the temperature is increased, the efficiency will decrease because HCN escapes more readily. Similarly, the efficiency decreases as the pH decreases because the $CN^-$ concentration decreases. Thus, higher $CN^-$ concentrations also permit higher plating speeds. Reasonable replenishing efficiencies and efficient bath operations are obtained for plating bath temperatures between 20 degrees and 80 degrees C.

We claim:

1. A method of replenishing gold in a gold electroplating bath comprising the steps of:

establishing a free cyanide concentration in said plating solution having a pH of at least 3 by plating from a solution comprising at least one member selected from the group consisting of $KAu(CN)_2$, $NaAu(CN)_2$, $LiAu(CN)_2$, and $NH_4Au(CN)_2$; and circulating said plating solution through at least one vessel

CHARACTERIZED IN THAT said vessel contains AuCN.

2. A method as recited in claim 1 in which said plating bath has a free cyanide concentration of at least 0.01 gm/liter.

3. A method as recited in claim 2 in which said AuCN is pelleted.

4. A method as recited in claim 3 in which said circulating step uses at least two series connected vessels.

5. A method as recited in claim 3 in which said circulating step uses at least two parallel connected vessels.

6. A method as recited in claim 2 in which said plating solution has a temperature between 20 and 80 degrees C.

7. A method as recited in claim 6 in which circulating step has a replenishing efficiency approximately proportional to $(V_f/V_b)\ (C_l/C_d)^{0.7}$, where $V_f$ is the volume flow rate, $V_b$ is the bath volume, $C_l$ is the column length, and $C_d$ is the column diameter.

* * * * *

UNITED STATES PATENT AND TRADEMARK OFFICE

CERTIFICATE OF CORRECTION

PATENT NO. : 4,340,451

DATED : July 20, 1982

INVENTOR(S) : Yutaka Okinaka and Catherine Wolowodiuk

It is certified that error appears in the above—identified patent and that said Letters Patent is hereby corrected as shown below: On the title page In the Abstract, line 6, "$Au(CN)_2$-ion" should read --$Au(CN)_2^-$ ion--. Column 1, line 1, "GOLD/IN" should read --GOLD IN--. Column 2, line 59, "$Au(CN)_2$-" should read --$Au(CN)_2^-$--. Column 3, line 66, "CN-" should read --$CN^-$--. Column 4, line 9, that portion of the formula reading "$Au(CN)_2$-" should read --$Au(CN)_2^-$--. Column 4, line 14, that portion of the formula reading "$Au(CN)_2$-" should read --$Au(CN)_2^-$--.

Signed and Sealed this

*Twenty-sixth* Day of *October 1982*

[SEAL]

*Attest:*

*Attesting Officer*

GERALD J. MOSSINGHOFF

*Commissioner of Patents and Trademarks*